US007270473B2

(12) United States Patent
Donthnier et al.

(10) Patent No.: US 7,270,473 B2
(45) Date of Patent: Sep. 18, 2007

(54) BOWL SCRAPER AND RELATED ATTACHMENT SYSTEM FOR MIXING MACHINE

(75) Inventors: Thomas S. Donthnier, Vandalia, OH (US); Janice J. Schnipke, Springfield, OH (US); Neal H. Blackburn, Springfield, OH (US)

(73) Assignee: Premark FEG LLC, Wilmington, DE (US)

( * ) Notice: Subject to any disclaimer, the term of this patent is extended or adjusted under 35 U.S.C. 154(b) by 183 days.

(21) Appl. No.: 11/064,209

(22) Filed: Feb. 23, 2005

(65) Prior Publication Data

US 2005/0150055 A1 Jul. 14, 2005

Related U.S. Application Data

(63) Continuation-in-part of application No. 10/328,090, filed on Dec. 23, 2002, now Pat. No. 6,866,413.

(51) Int. Cl.
*B01F 15/00* (2006.01)

(52) U.S. Cl. ..... 366/309; 366/331

(58) Field of Classification Search ..... 366/67, 366/96–98, 197–198, 203, 207, 288, 309, 366/312, 313, 331; 99/348
See application file for complete search history.

(56) References Cited

U.S. PATENT DOCUMENTS 370,335 A * 9/1887 Hunter ..... 366/288
535,880 A 3/1895 Anderson
682,292 A * 9/1901 Sukalle ..... 165/85
1,415,735 A * 5/1922 Trust et al. ..... 366/288
1,467,820 A * 9/1923 Trust et al. ..... 366/331
1,674,903 A * 6/1928 Johnston et al. ..... 366/288
1,872,004 A * 8/1932 Rataiczak et al. ..... 366/309
2,169,014 A 8/1939 Aalborg
2,562,790 A * 7/1951 Houston, Jr. ..... 366/200
2,630,303 A * 3/1953 Krucker ..... 366/331

(Continued)

FOREIGN PATENT DOCUMENTS

CA 2201529 * 10/1998

(Continued)

OTHER PUBLICATIONS

"General Purpose Couplings, Chrome-Plated Brass, 4" Flow, LC Series," catalog by CPC, pp. 22-23, date unknown.

(Continued)

*Primary Examiner*—Charles E. Cooley
(74) *Attorney, Agent, or Firm*—Thompson Hine LLP

(57) ABSTRACT

A bowl scraper is configured for attachment to a rotatable mixing machine support such that forces exerted on the bowl scraper during scraping operations hold the bowl scraper in place. The bowl scraper includes an attachment arm including an upper arm portion and a lower arm portion, wherein the upper arm portion and the lower arm portion are formed by a bent elongated member. The upper arm portion includes an opening extending through the bent elongated member. The opening has a first portion and a second portion, the first portion of the opening being larger than the second portion of the opening. A scraper extends downward from the lower arm portion.

16 Claims, 9 Drawing Sheets

U.S. PATENT DOCUMENTS

| | | | | | |
|---|---|---|---|---|---|
| 2,639,904 | A | | 5/1953 | McMaster et al. | |
| 2,640,688 | A | * | 6/1953 | Moller | 366/97 |
| 2,651,582 | A | * | 9/1953 | Courtney | 106/167.01 |
| 3,073,579 | A | * | 1/1963 | Detrick | 366/200 |
| 3,415,497 | A | * | 12/1968 | Johnson | 366/247 |
| 4,190,371 | A | * | 2/1980 | Durr et al. | 366/139 |
| 4,311,397 | A | * | 1/1982 | Wright | 366/98 |
| 4,337,000 | A | * | 6/1982 | Lehmann | 366/288 |
| 4,380,398 | A | * | 4/1983 | Burgess | 366/261 |
| 4,436,125 | A | | 3/1984 | Blenkush | |
| 4,541,457 | A | | 9/1985 | Blenkush | |
| 4,760,984 | A | | 8/1988 | Hennessey | |
| 4,857,706 | A | | 8/1989 | Diamond | |
| 4,946,285 | A | * | 8/1990 | Vennemeyer | 366/288 |
| 5,052,725 | A | | 10/1991 | Meyer et al. | |
| 5,104,158 | A | | 4/1992 | Meyer et al. | |
| D332,722 | S | * | 1/1993 | Torbet et al. | D7/412 |
| 5,201,121 | A | * | 4/1993 | Heiberg | 30/123 |
| 5,316,041 | A | | 5/1994 | Ramacier, Jr. et al. | |
| 5,464,300 | A | | 11/1995 | Crainich | |
| 5,494,074 | A | | 2/1996 | Ramacier, Jr. et al. | |
| 5,556,201 | A | * | 9/1996 | Veltrop et al. | 366/203 |
| 5,791,777 | A | * | 8/1998 | Mak | 366/129 |
| 5,911,403 | A | | 6/1999 | deCler et al. | |
| 5,938,244 | A | | 8/1999 | Meyer | |
| 5,975,489 | A | | 11/1999 | deCler et al. | |
| 6,024,124 | A | | 2/2000 | Braun et al. | |
| 6,082,401 | A | | 7/2000 | Braun et al. | |
| 6,533,448 | B1 | * | 3/2003 | Drocco | 366/98 |
| 6,866,413 | B2 | * | 3/2005 | Donthnier et al. | 366/309 |
| 6,908,222 | B2 | * | 6/2005 | Brunswick et al. | 366/331 |
| 6,932,503 | B2 | * | 8/2005 | Fallowes | 366/309 |
| 7,021,817 | B2 | * | 4/2006 | Huang et al. | 366/331 |
| 2002/0181322 | A1 | * | 12/2002 | Brunswick et al. | 366/197 |
| 2003/0053368 | A1 | * | 3/2003 | Drocco | 366/98 |
| 2004/0120218 | A1 | * | 6/2004 | Donthnier et al. | 366/309 |
| 2004/0194636 | A1 | * | 10/2004 | Huang et al. | 99/348 |
| 2006/0171251 | A1 | * | 8/2006 | Busick | 366/312 |
| 2006/0209629 | A1 | * | 9/2006 | Fallowes et al. | 366/312 |
| 2006/0268659 | A1 | * | 11/2006 | Kaas | 366/312 |

FOREIGN PATENT DOCUMENTS

| | | | |
|---|---|---|---|
| DE | 1174954 | | 7/1964 |
| DE | 2802155 | | 7/1979 |
| GB | 246926 | | 2/1926 |
| GB | 308163 | | 3/1929 |
| GB | 889462 | | 2/1962 |
| JP | 11-347390 | * | 12/1999 |
| PT | 80429 | * | 11/1985 |

OTHER PUBLICATIONS

Instructions manual entitled "H600 & L800 Mixers," Hobart Corporation (Dec. 1999).

Service manual entitled "Models H-600 and H-600-T and L-800 Mixers," Hobart Corporation (Sep. 1977).

* cited by examiner

BOWL SCRAPER AND RELATED ATTACHMENT SYSTEM FOR MIXING MACHINE

CROSS REFERENCE TO RELATED APPLICATION

The present application is a continuation-in-part of application Ser. No. 10/328,090, now U.S. Pat. No. 6,866,413 B2, filed Dec. 23, 2002.

TECHNICAL FIELD

The present application relates generally to mixing machines utilized for mixing food products such as cake batter, and more particularly to a mixing machine bowl scraper and related attachment system for the same.

BACKGROUND

The use of bowl scrapers in food mixing machines is known as from U.S. Pat. No. 4,946,285. The scraper is positioned to slide along the interior side of the mixing bowl to remove food product therefrom to assure more thorough mixing. The described arrangement in U.S. Pat. No. 4,946,285 requires the use of moving parts and therefore increases manufacturing costs.

Accordingly, it would be advantageous to provide a mixing machine with an improved bowl scraper and associated attachment system.

SUMMARY

In one aspect, a bowl scraper for use in a mixing machine includes an attachment arm including an upper arm portion and a lower arm portion, wherein the upper arm portion and the lower arm portion are formed by a bent elongated member, the upper arm portion including a through opening extending through the bent elongated member, the through opening having a first portion and a second portion, the first portion of the through opening larger than the second portion of the through opening. A scraper extends downward from the lower arm portion.

DETAILED DESCRIPTION

Figure 1:
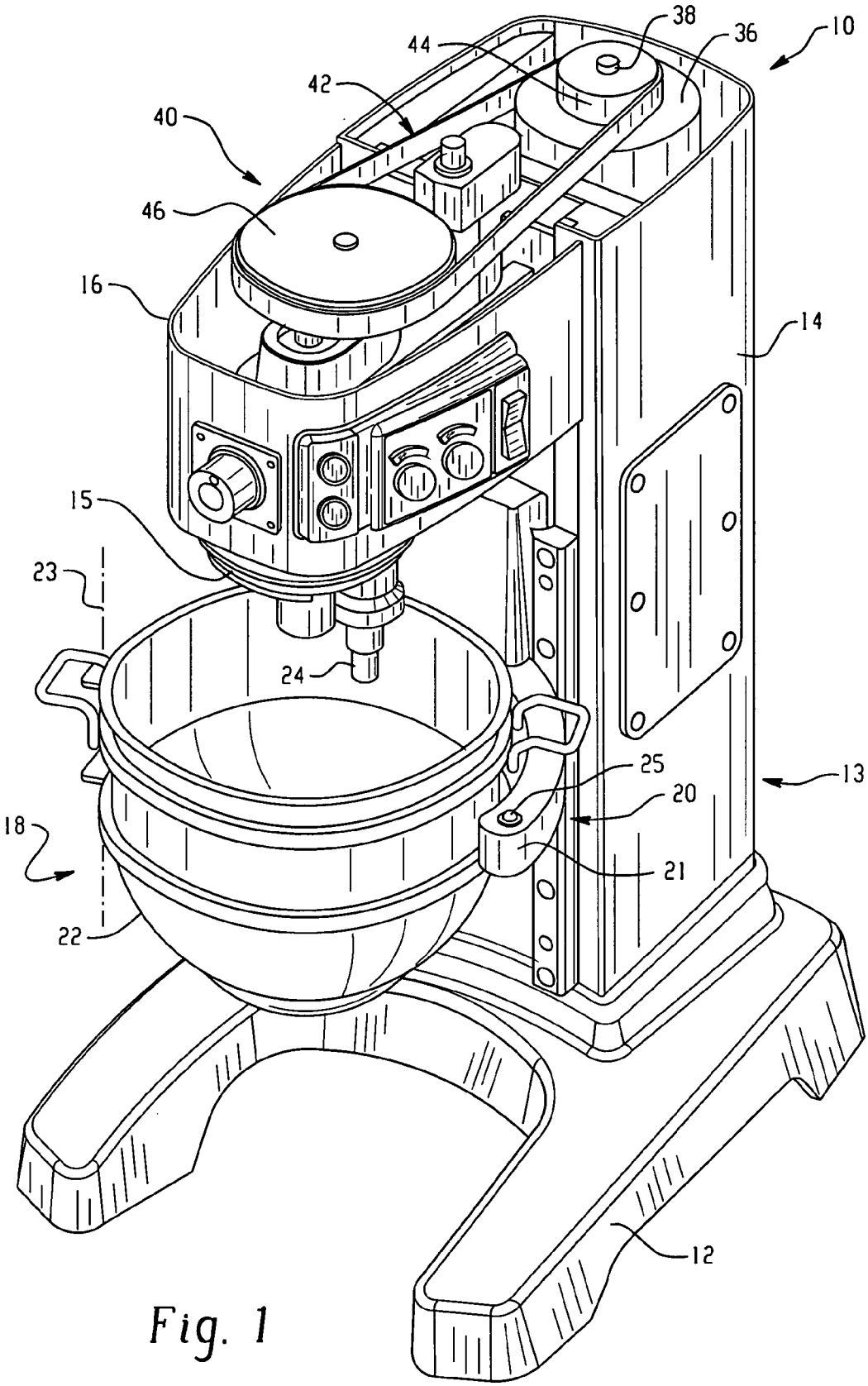
FIG. 1 is a perspective view of a mixing machine with the top cover removed.
Figure 2:
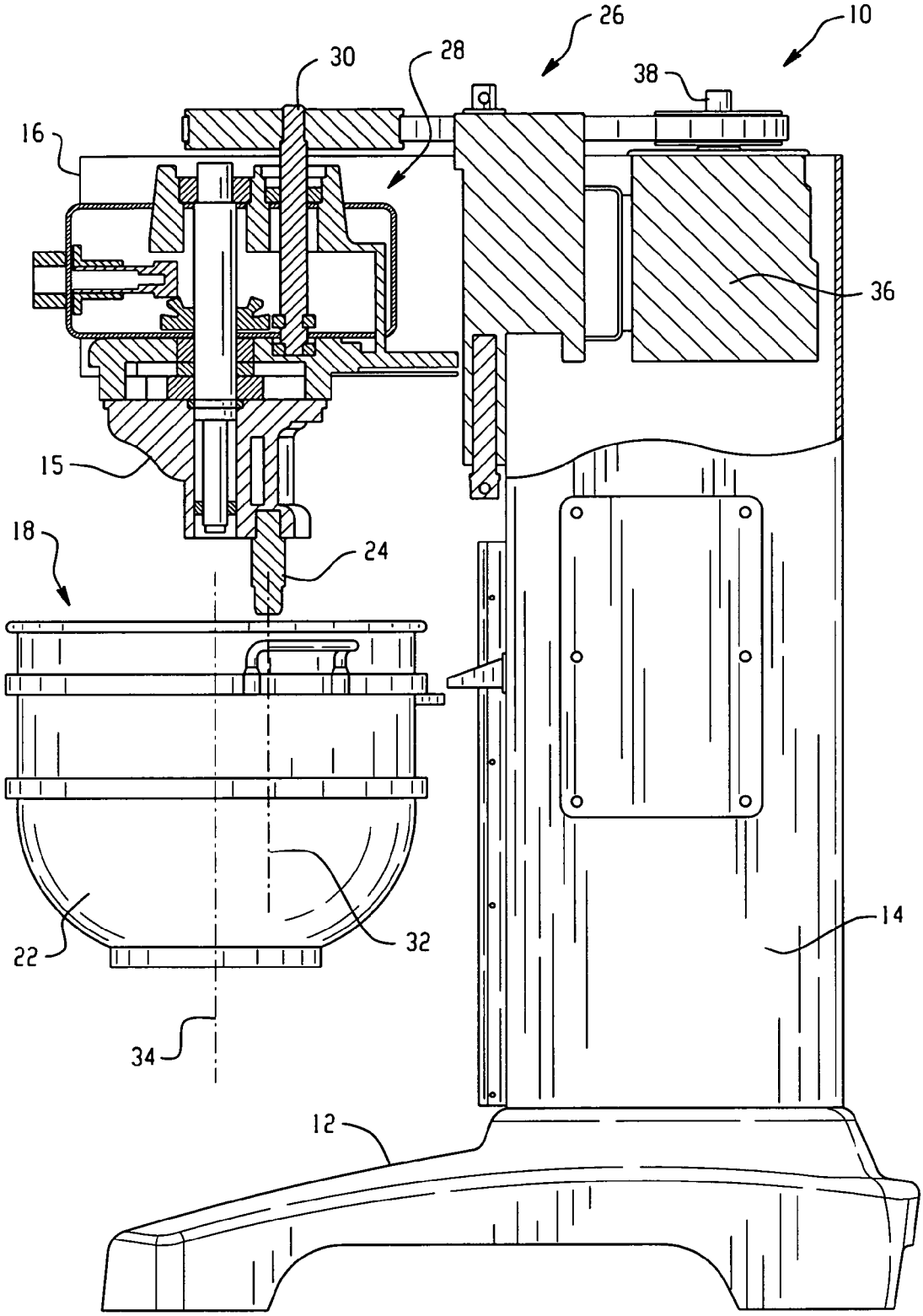
FIG. 2 is a side elevation of the mixing machine of FIG. 1 in partial cross-section.

Referring to FIGS. 1-2, a mixing machine 10 is shown and includes a base 12, a mixer body 13 including a column 14 extending upward from the base 10, and a head 16 extending outward from the column 14 and over a bowl receiving location 18. The bowl receiving location 18 may be defined by a bowl receiving portion 20 of the mixer body 13, where the bowl receiving portion 20 has spaced apart curved arms 21 defining a curved shape to match the bowl 22. The head includes a head component 15 that at least partially houses a downwardly extending rotatable output member 24 that can receive a mixer tool such as a flat beater, whisk or other tool. The head 16 and upper portion of the column 14 typically include a detachable cover (not shown) for enclosing the components.

The mixing machine includes a drive assembly 26 for effecting rotation of the rotatable output member 24. In the illustrated machine the drive assembly is formed in part by a gear system 28 within the head 16 and having an upwardly extending input drive shaft 30. In the case of a planetary mixer, the gear system 28 may take the form of a planetary gear system, in which case the rotatable output member 24 rotates about its own axis 32, with the axis 32 rotating or "orbiting" around a central bowl axis 34. Also forming part of the drive assembly is a drive motor 36 that is mounted and located in line with the column 14 and includes an upwardly extending output shaft 38. A drive linkage 40 connects the motor output shaft 38 to the gear system input shaft 30 and may be formed by the illustrated belt 42 and pulleys 44 and 46. Alternative drive linkages could take the form of chain and sprocket combinations, additional gearing and/or bar-type linkages. The illustrated drive linkage 40 is a fixed linkage, meaning that the drive ratio between the motor output shaft 38 and the gear system input shaft 30 does not change.

The bowl 22 may be pivotally mounted for movement about a pivot axis 23 at one side of the bowl receiving portion 20, with the other side of the bowl receiving portion including a pin 25 for engaging part of the bowl and holding it in an operating position. Further details of such pivoting bowl arrangements are provided in U.S. Patent Application Publication No. US 2002/0093877 A1, published Jul. 18, 2002.

Figure 3:
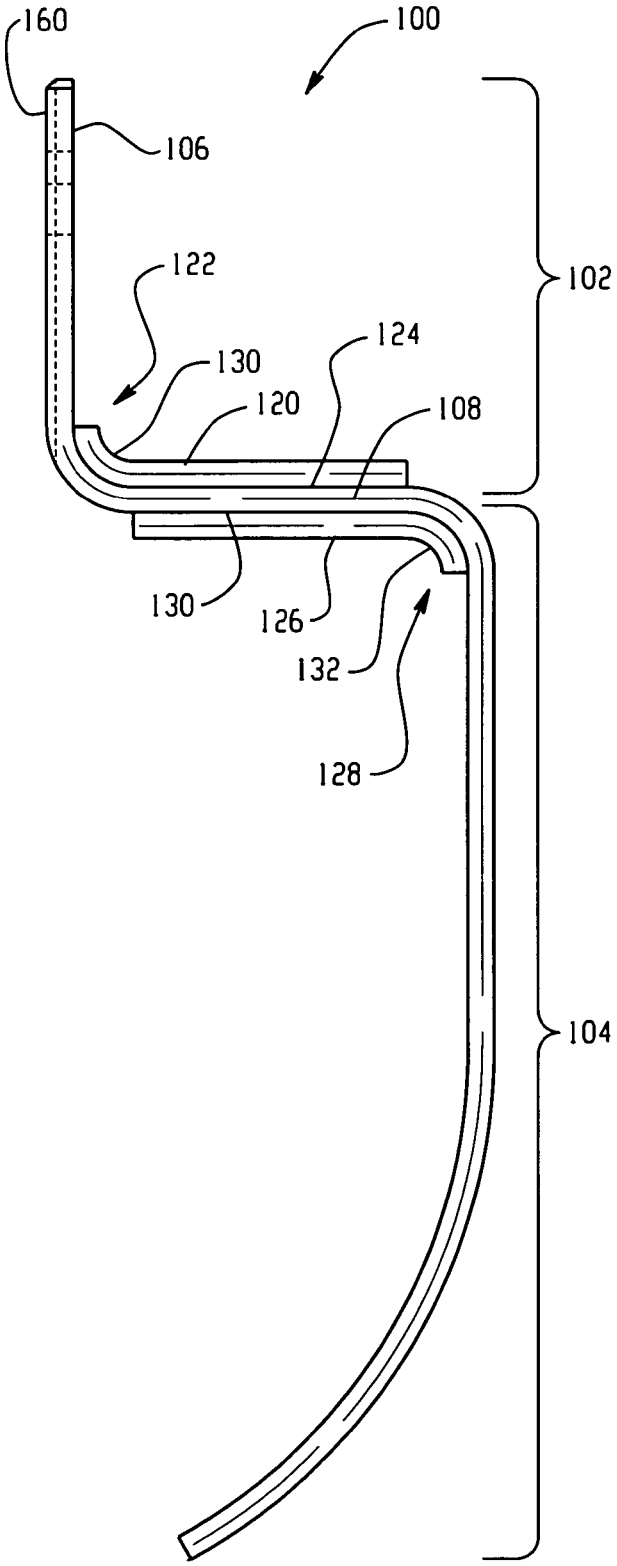
FIG. 3 s a side elevation of a bowl scraper.
Figure 4:
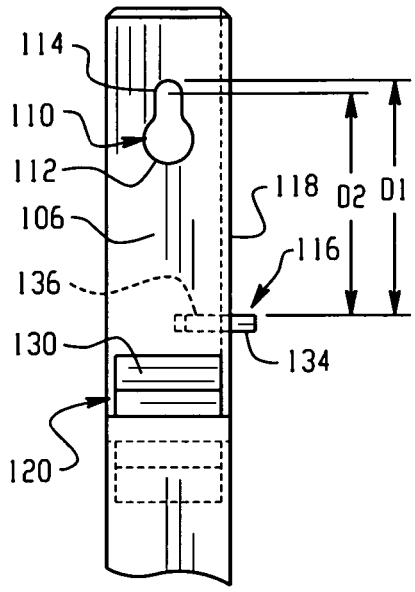
FIG. 4 is a partial front elevation of the bowl scraper of FIG. 4.

Referring now to FIGS. 3 and 4, a bowl scraper 100 and related attachment arrangement are now described. In particular, the bowl scraper 100 includes an attachment arm 102 and a scraper 104. The attachment arm 102 includes an upper arm portion 106 and a lower arm portion 108. The upper arm portion 106 includes a through opening 110 having a lower portion 112 and an upper portion 114, the lower portion 112 larger than the upper portion 114. A protrusion 116 extends from a side 118 of the upper arm portion 106 and is spaced below the through opening 110.

The illustrated attachment arm 102 is substantially L-shaped, with upper arm portion 106 extending substantially vertically and lower arm portion 108 extending laterally from the upper arm portion 106. The scraper 104 extends downward from the lower arm portion 108. The attachment arm 102 and scraper 104 may be unitary with each other, with both portions being formed by bending an elongated steel member. The scraper 104 is bent to an appropriate shape to match a bowl to be scraped and may typically also include a urethane sleeve that slides onto the bent steel member.

An upper brace 120 extends from a region 122 of intersection of the upper arm portion 106 and the lower arm portion 108 and toward the scraper 104 along an upper side of 124 the lower arm portion 108. Similarly, a lower brace 126 extends from a region 128 of intersection of the lower arm portion 108 and the scraper 104 and toward the upper arm portion 106 along a lower side 130 of the lower arm portion 108. Both braces may be formed of steel that is welded to the primary elongated steel member forming the implement. As illustrated, each brace 120 and 126 may includes a respective curved portion 130 and 132 in the respective region 122 and 128 to match the curvature of such regions. The braces 120 and 126 add strength to the implement.

The protrusion 116 may be formed by a pin 134 that is inserted into an opening 136 machined in the side 118 of the upper arm portion 106. Alternatively, the protrusion could be formed unitary with the upper arm portion. In certain embodiments the protrusion could, for example, extend from the back side of the upper arm portion. In one embodiment, a distance D1 between a top edge of the through opening 110 and a top edge of the protrusion 116 is between about 3.2 inches and about 3.4 inches, and is preferably about 3.3 inches. The smaller portion 114 represents an install location of the through opening 110, and in one embodiment a distance D2 between a mid-point of the install location and the top edge of the protrusion 116 is between about 3.0 and 3.2 inches, and preferably about 3.125 inches.

Figure 5:
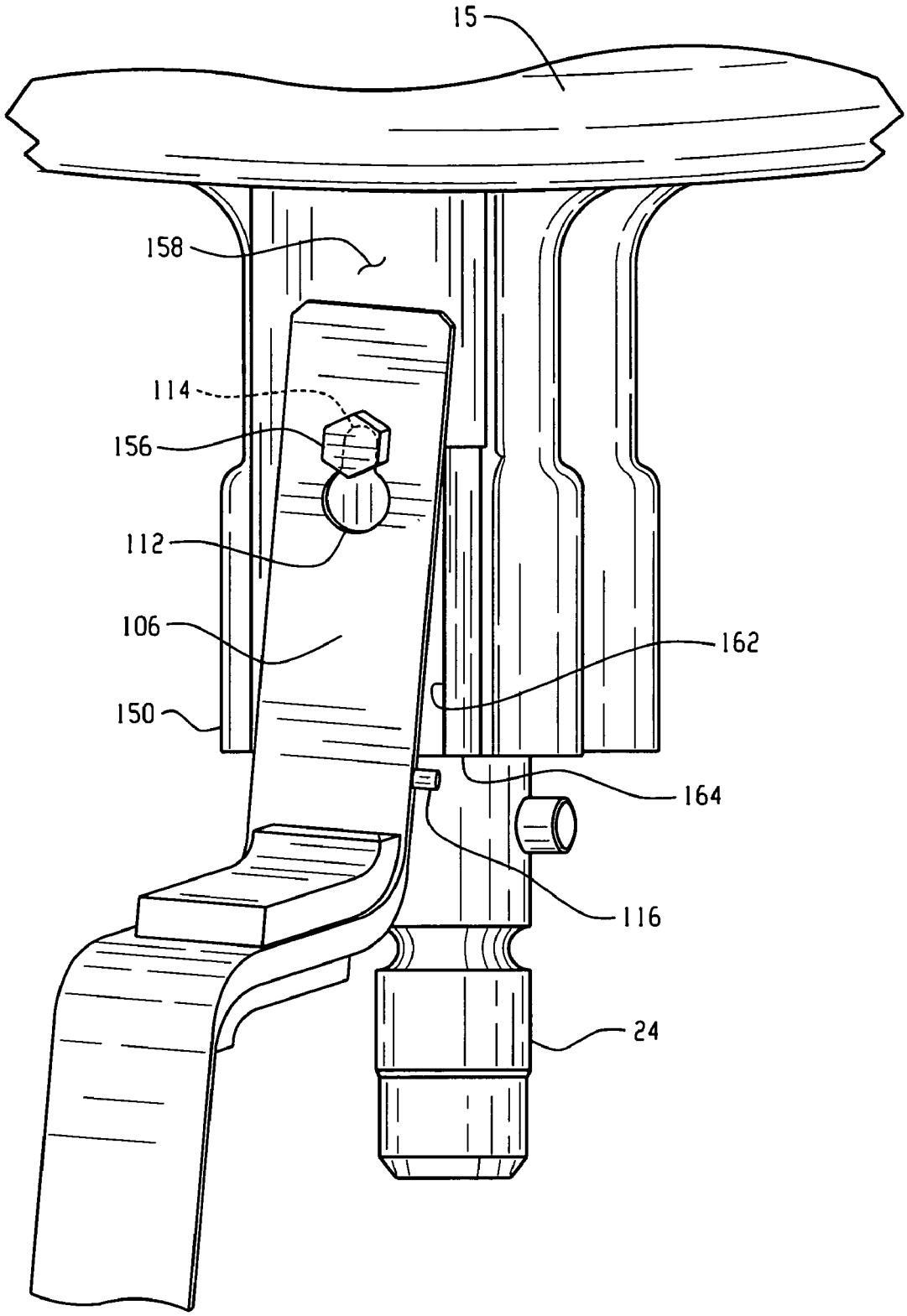
FIG. 5 is a partial perspective view of the bowl scraper of FIG. 4 being installed on a mixing machine.
Figure 6:
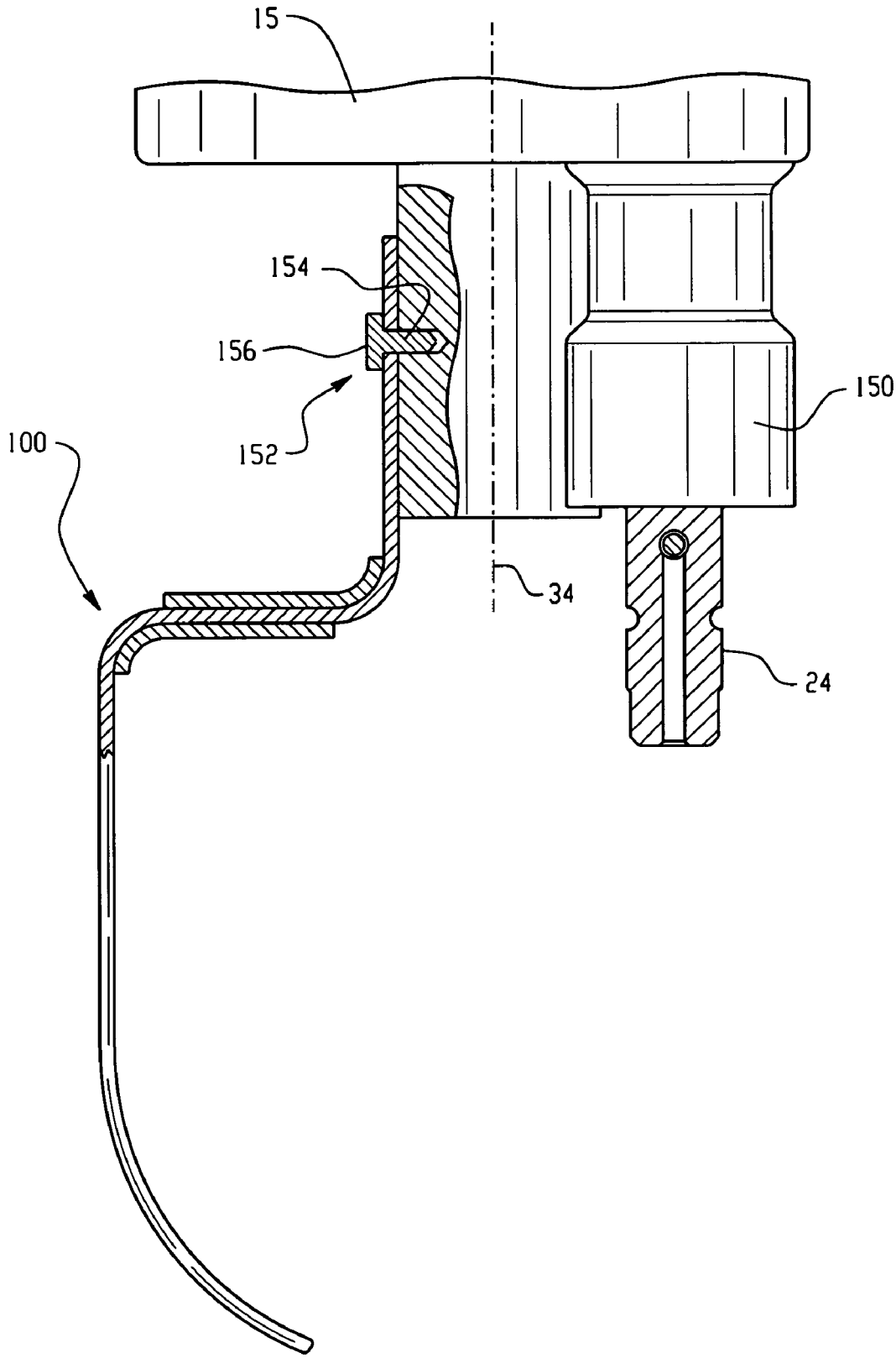
FIG. 6 is a side cross-section of the bowl scraper when installed on the mixing machine.

Reference is now made to FIGS. 5 and 6 for a description of the use of the scraper arm 100. In particular, FIG. 5 shows the underside of a mixer head including a rotatable output member 24 in the form of a shaft for receiving a mixer tool. The member 24 extends from a support 150 that is rotated about axis 34 during mixing operations. The support 150 includes a laterally extending mount protrusion 152 including a shaft 154 and an enlarged head 156 spaced from the support 150. The mount protrusion 152 may be formed by a bolt inserted through a spacer into a threaded opening of the support 150, with the opening formed on a substantially planar surface portion 158 of the support 150 to permit the back side 160 of upper arm portion 106 to lie thereagainst. The enlarged head 156 is sized to permit passing through the lower portion 112 of through opening 110, but to prevent passing through the upper portion 114 of the through opening. The support 150 also includes a side shoulder 162 spaced from the mount protrusion 152, with the shoulder 162 laterally raised relative to the surface portion 158. In the illustrated embodiment the side shoulder 162 extends substantially vertically and begins at or below a height of the mount protrusion and extends downward. A lower stop surface 164 is provided on the underside of support 150, spaced below the mount protrusion 152.

In order to mount the scraper 100 onto the mixing machine, support 150 is rotated about axis 34 to bring support surface 158 toward a front of the mixing machine 10. Bowl 22 is unlatched from support arm 21 at pin 25 and pivoted about axis 23 to facilitate access to support surface 158. The lower portion 112 of the through opening is aligned with the protrusion 152 and a lower part of the upper arm portion 106 is angled away from the side shoulder 162. The scraper 100 is then moved toward the support 150 to pass the enlarged head 152 of the protrusion through the through opening. The scraper is then moved to locate the shaft 154 of the protrusion 152 in the upper portion 114 of the through opening, such position being shown in FIG. 6. The scraper is then rotated (counterclockwise about mount protrusion 152 of FIG. 5) to position part of the upper arm portion 106 against the side shoulder 162 and to locate the protrusion 116 below and adjacent the stop surface 164. The bowl 22 is then pivoted back around axis 23 to its latched, operating position.

In this resulting, installed position the side shoulder 162 cooperates with the side of the upper arm portion 106 to prevent further counterclockwise rotation about the mount protrusion 152, the forces exerted on the scraper during scraping acting to push the side of the upper arm portion 106 into the side shoulder. The protrusion 116 cooperates with the stop surface 164 to prevent the scraper from sliding upward along the support 150, the forces exerted upward on the scraper during scraping acting to push the protrusion against the stop surface 164. Additionally, forces exerted on the scraper during scraping will also tend to urge the upper arm portion 106 toward the enlarged head 156 of the mount protrusion 152. Thus, the scraper is held in place by mechanical forces exerted on in it during scraping operations. To remove the scraper, support 150 is rotated about axis 34 to bring support surface 158 toward a front of the mixing machine 10. Bowl 22 is unlatched from support arm 21 at pin 25 and pivoted about axis 23 to facilitate access to the support surface 158. The upper arm portion is rotated away from the side shoulder 162, the scraper arm is moved upward to position the head in the lower portion 112 of the through opening, and the scraper is pulled laterally away from the support 150.

Figure 7A:
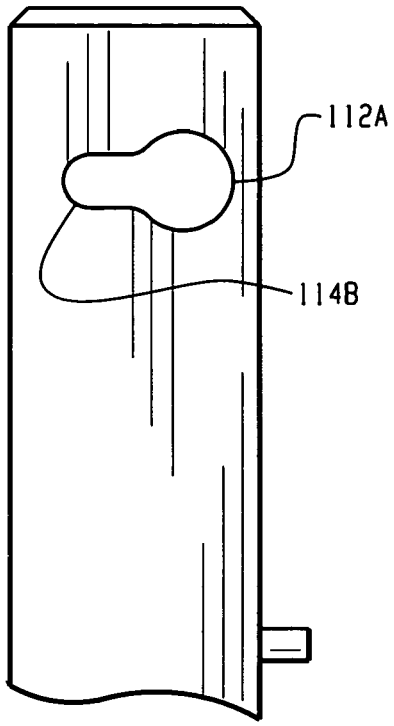
FIGS. 7A-7D show alternative scraper attachment arm embodiments.
Figure 7B:
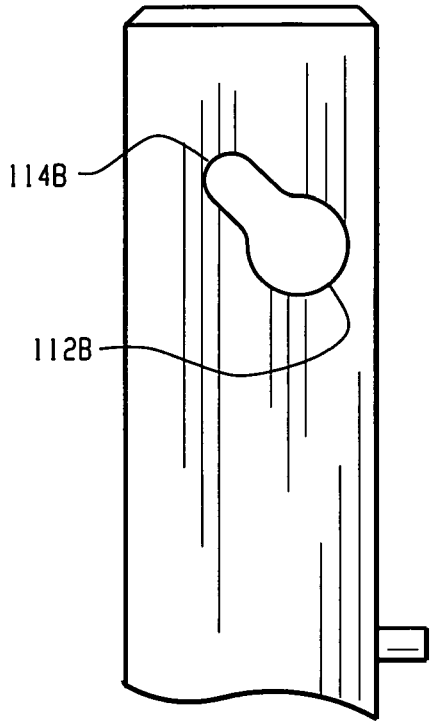
Figure 7C:
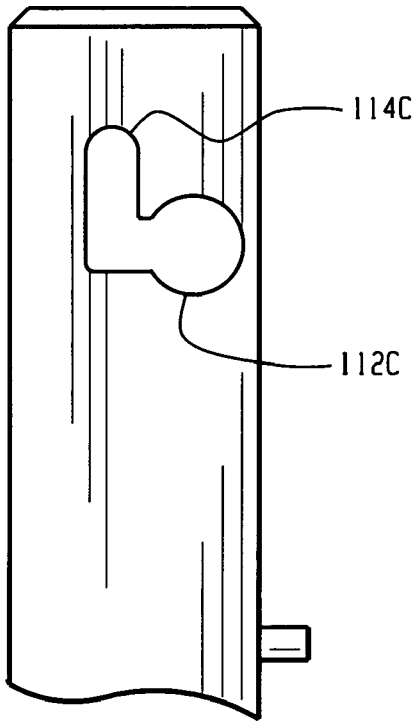
Figure 7D:
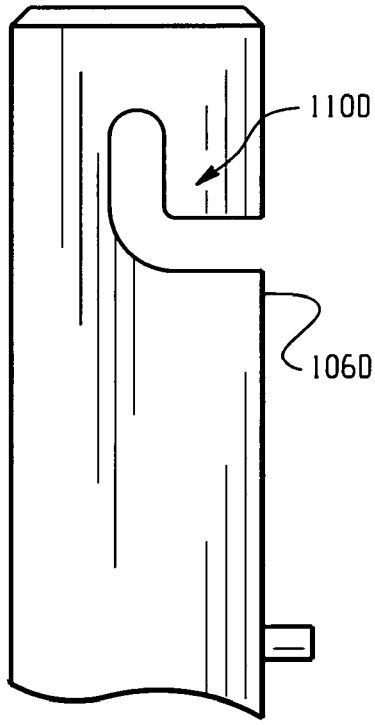

While the above-described embodiment provides a through opening in which the enlarged portion is located below the smaller portion, it is recognized that variations are possible. For example, reference is made to FIGS. 7A-7D where alternative opening configurations for the bowl scraper are shown. FIG. 7A shows an embodiment positioning the enlarged portion 112A laterally alongside the smaller portion 114A. FIG. 7B shows an embodiment positioning the enlarged portion 112B at a position diagonally offset from the smaller portion 114B. FIG. 7C shows an embodiment in which the larger portion 112C is positioned alongside and below the smaller portion 114C by an L-shaped bend. FIG. 7D shows an embodiment in which the entire opening 110D is sized to prevent passage of the enlarged head 156, but the opening extends all the way to the edge of the upper arm portion 106D to allow the shaft 154 of the mount protrusion 152 to be slid into the opening. In another variation the enlarged part of the opening could be positioned above the smaller part. In the latter case the protrusion extending from the scraper arm could be positioned in a slot, such as a slot in the side shoulder, to prevent both upward and downward movement of the bowl scraper.

In another variation of the previously mentioned embodiment in which the protrusion extends from the back side of the scraper arm, the protrusion could be formed by the extending part of a pin that is spring-loaded into the scraper arm itself. In such an embodiment the surface 158 would include an opening formed therein to receive the pin when the scraper is mounted to the mixer. In such an embodiment, it is possible that the side shoulder and support surface could both be formed by the wall of the opening formed in the surface 158.

Figure 8:
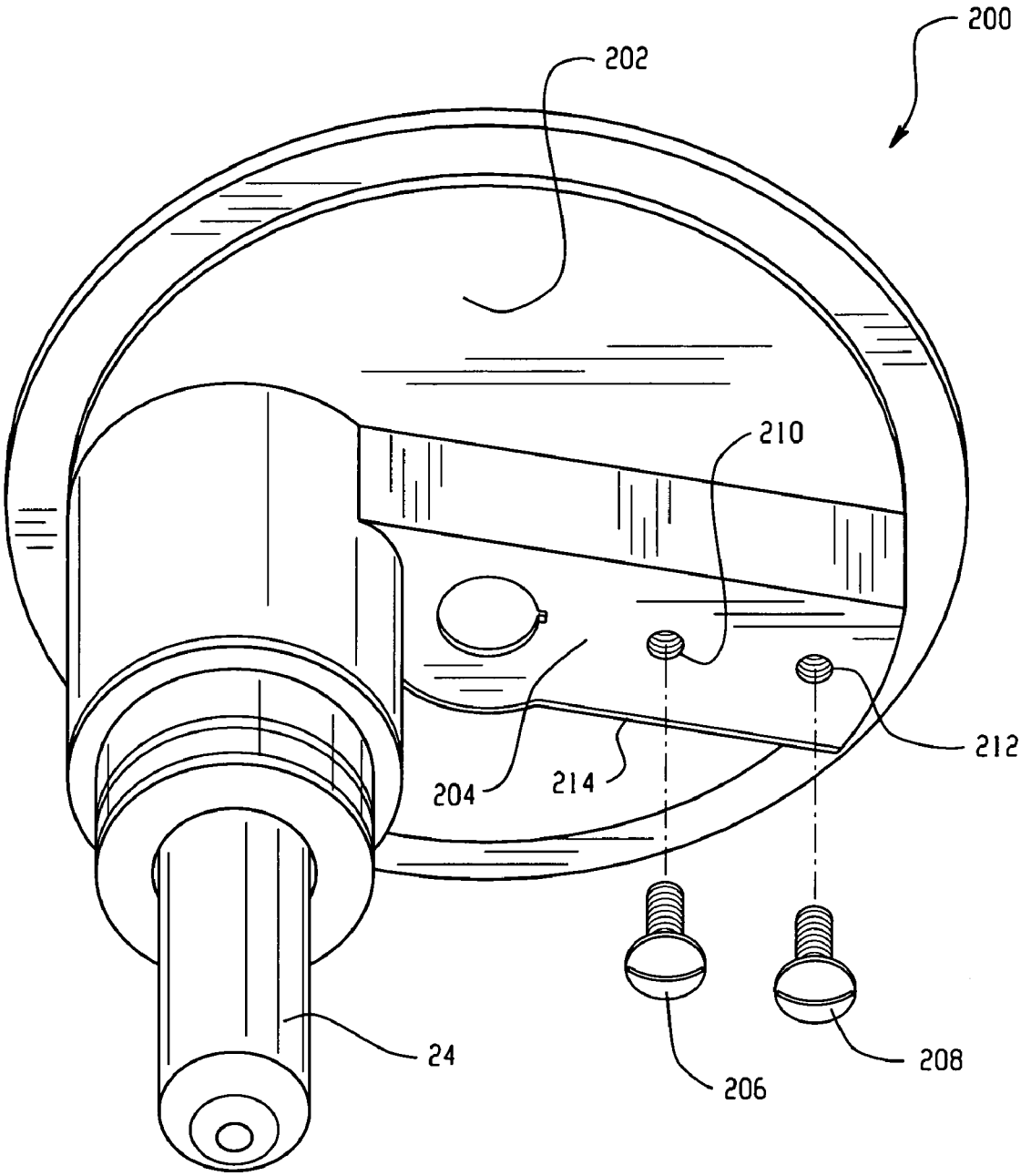
FIG. 8 is an exploded view of an alternative head component for use with the mixing machine of FIG. 1 including multiple mount protrusions, rotatable output member and scraper support.
Figure 10:
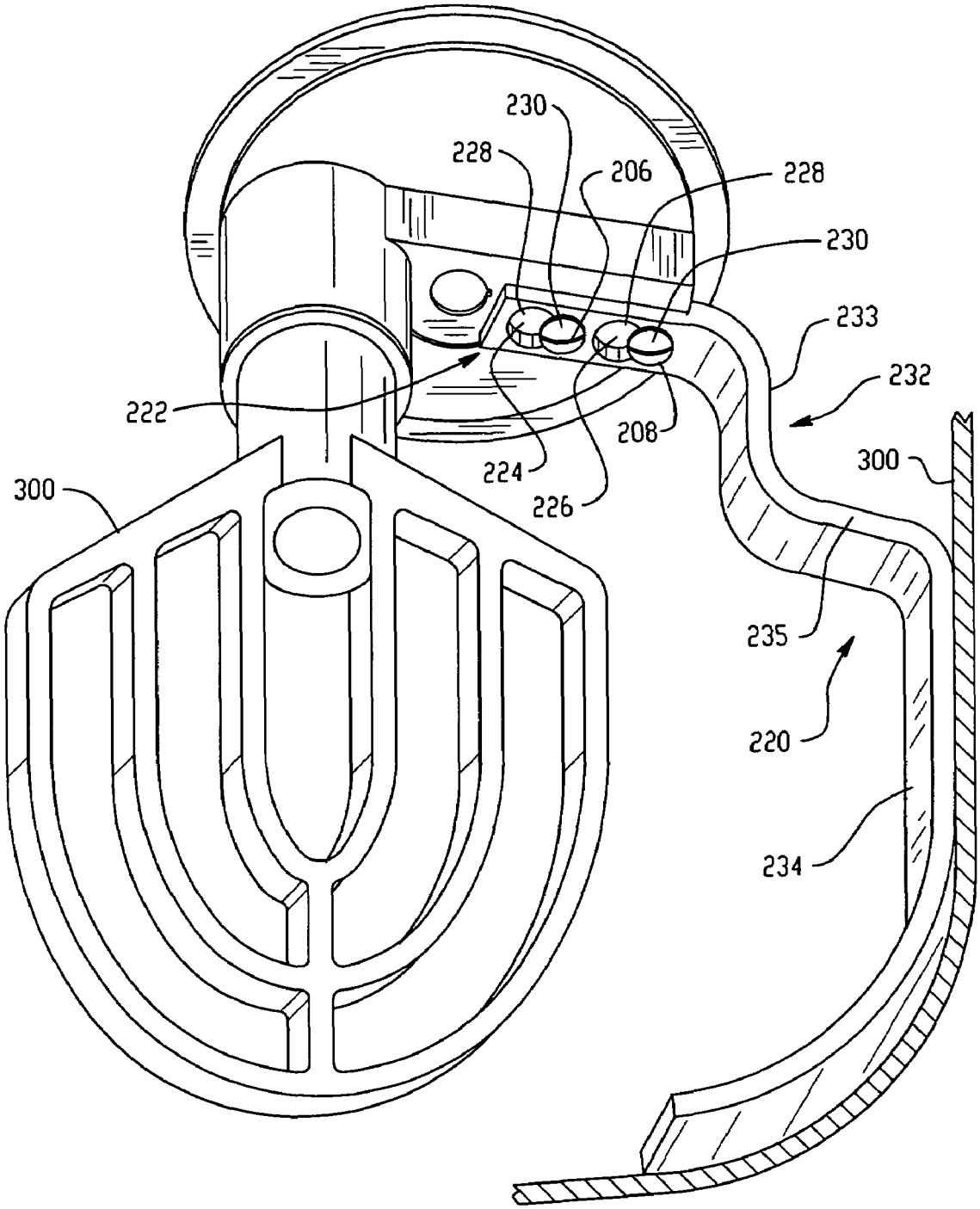
FIG. 10 is a perspective view of the head component of FIG. 8 connected to the scraper arm of FIG. 9.

Referring now to FIG. 8, an alternative head component 200 is shown suitable for use with mixing machine 10 (FIG. 1) that includes output member 24 capable of receiving a mixing tool (see, e.g., element 300 of FIG. 10). The output member 24 extends from a support 202 having a laterally extending planar surface portion 204 that extends substantially transverse to the vertically extending output member 24. Head component 200 includes vertically oriented mount protrusions 152, similar to those described above, that may be formed by bolts 206, 208 inserted into respective threaded openings 210, 212 that extend inwardly from the planar surface portion 204 of the support 202. To aid in inhibiting rotation of the scraper relative to the bolts 206, 208, support 202 also includes a side shoulder 214 spaced from threaded openings 210, 212 and vertically offset relative to planar surface portion 204 to form a laterally extending seating surface or shoulder capable of engaging an edge of a scraper to guide the scraper toward the bolts (see FIG. 10).

Figure 9:
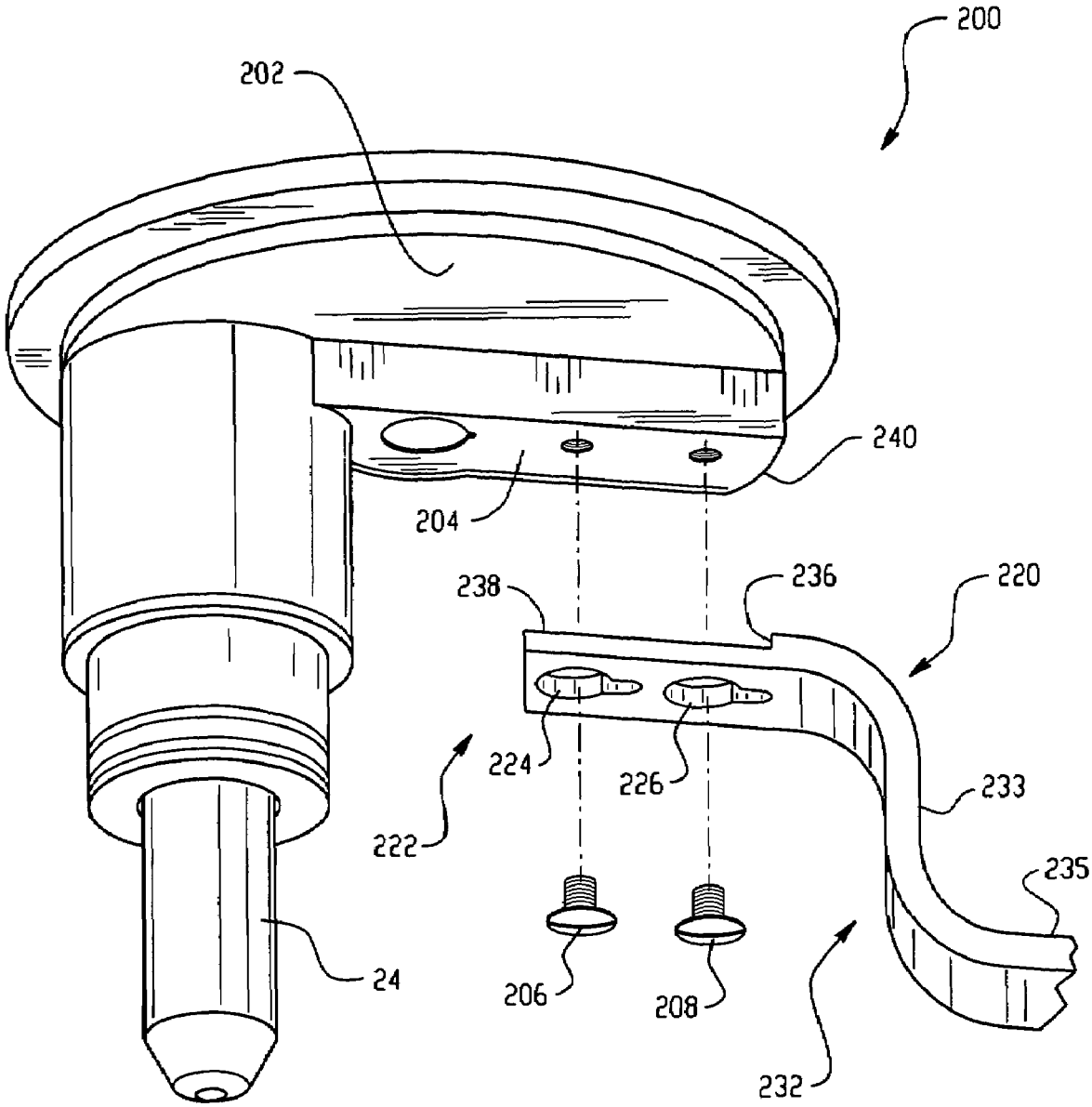
FIG. 9 is an exploded view of the head component of FIG. 8 and an embodiment of a scraper arm.

Referring to FIGS. 9 and 10, planar surface portion 204 is arranged to receive a laterally or horizontally oriented upper connecting portion 222 of a scraper arm 220. In particular, scraper 220 includes an attachment arm including an upper portion 222, and a lower portion 232. Upper connecting portion 222 includes multiple through openings 224 and 226 (FIG. 10), each having a larger portion 228 and a smaller portion 230, similar to, for example, the through opening 110 described with reference to FIG. 4.

Scraper 220, as shown, may be of unitary construction formed of a single piece of bent material, such a bent elongated steel member. Scraper 220 includes the upper connecting portion 222, downwardly extending lower portion 232 that includes segments 233 and 235, and a scraper portion 234 extending downwardly from the portion 232 (FIG. 10). Alternatively, the scraper may be formed of multiple connected components, such as an attaching arm including the upper connecting portion 222 and lower portion 232 and an attached, but separately formed, scraper including scraper portion 234.

As can best be seen by FIG. 9, in one embodiment a protrusion 236 may extend upward from the top surface 238 of the scraper arm 220. Protrusion 236 forms a seating surface capable of abutting against a stop surface 240 of the support 200. In other embodiments, the protrusion 236 and associated seating surface may be eliminated.

When installed on the mixer for operation in connection with material in a mixing bowl, the engagement of the scraper portion with the inside surface of the mixing bowl 300 (shown in schematic, partial cross-section) urges the scraper inward (e.g., generally to the left in the view of FIG. 10) so that the mount protrusions 206, 208 are aligned in the smaller portions of the through openings 228. Likewise, forces exerted by contact with the mixing bowl during mixing tend to urge the side edge of the upper arm portion 222 against the side shoulder 214 to urge the smaller portions 230 of the scraper openings against the side of the bolts.

It is to be clearly understood that the above description is intended by way of illustration and example only and is not intended to be taken by way of limitation. Other changes and modifications could be made, including both narrowing and broadening variations and modifications of the appended claims.

What is claimed is:

1. A bowl scraper for use in a mixing machine, comprising:

an attachment arm including an upper arm portion and a lower arm portion, wherein the upper arm portion and the lower arm portion are formed by a bent elongated member, the upper arm portion including an opening extending through the bent elongated member, the opening having a first portion and a second portion, the first portion of the opening larger than the second portion of the opening, the first portion of the opening being sized and configured to receive a mount protrusion of the mixing machine for mounting the bowl scraper to the mixing machine; and a scraper extending downward from the lower arm portion;

wherein the upper arm portion extends generally horizontally and the lower arm portion includes a generally vertical segment and a generally horizontal segment.

2. The bowl scraper of claim 1 wherein the first portion of the opening is located adjacent the second portion of the opening.

3. The bowl scraper of claim 1 wherein the first portion of the opening defines a connect/disconnect location of the opening and the second portion of the opening defines an install location of the opening.

4. The bowl scraper of claim 1 wherein the attachment arm and scraper are unitary with each other.

5. The bowl scraper of claim 1, wherein the upper arm portion includes a second opening extending through the bent elongated body and spaced apart from the first opening, the second opening having a first portion and a second portion, the first portion of the second opening being larger than the second portion of the second opening.

6. A mixing machine including the bowl scraper of claim 1, comprising: a head located above a bowl receiving area; a rotatable output member extending downwardly from the head and adapted for receiving a mixer tool; a scraper support disposed alongside the rotatable output member and having a downwardly extending mount protrusion including a shaft and an enlarged head; and the bowl scraper connected to the scraper support with the mount protrusion extending through the second portion of the through opening.

7. A mixing machine, comprising:

a head located above a bowl receiving area;

a rotatable output member extending downwardly from the head and adapted for receiving a mixer tool;

a scraper support disposed positioned alongside the rotatable output member and having a mount protrusion including a shaft and an enlarged head, the scraper support including a side shoulder; and a bowl scraper including an upper arm portion;

a lower arm portion connected to the upper arm portion; and a scraping portion connected to the lower arm portion;

wherein at least the upper arm portion and the lower arm portion are formed by a bent elongated member, the upper arm portion including a first opening extending through the bent elongated member, the opening having a first portion and a second portion, the first portion of the opening larger than the second portion of the opening;

the bowl scraper mounted on the scraper support with the mount protrusion extending through the second portion of the opening, the enlarged head sized to prevent passing through the second portion of the opening, and a side of the upper arm portion located adjacent the side shoulder.

8. The mixing machine of claim 7, wherein the scraper support includes a substantially planar surface portion arranged substantially traverse to the downwardly extending rotatable output member.

9. The mixing machine of claim 8, wherein the scraper support includes an opening extending inwardly from the planar surface portion, the opening receives an end of the mount protrusion.

10. The mixing machine of claim 7, wherein the upper arm portion includes a second opening extending through the bent elongated member and spaced apart from the first opening, the second opening having a first portion and a second portion, the first portion of the second opening being larger than the second portion of the second opening.

11. The mixing machine of claim 10 further comprising a second mount protrusion extending through the second portion of the second opening, the second mount protrusion including an enlarged head sized to prevent passing through the second portion of the second opening.

12. A bowl scraper for use in a mixing machine, comprising:

an attachment arm including a generally horizontal upper arm portion with a generally planar top surface portion, the upper arm portion having at least one opening that extends through the generally planar top surface portion, the opening having a first portion and a second portion, the first portion of the through opening larger than the second portion of the through opening; and a scraper extending downward from the attachment arm;

wherein the attachment arm further includes a lower arm portion with at least a first segment and a second segment, the upper arm portion extends in a first direction from the first segment and the second segment extends in a second direction from the first segment, the second direction is generally opposite the first direction, the second segment is offset vertically from the upper arm portion.

13. The bowl scraper of claim 12 wherein the upper arm portion includes first and second spaced apart through openings on the generally planar top surface portion.

14. A mixing machine including the bowl scraper of claim 12, comprising: a head located above a bowl receiving area; a rotatable output member extending downwardly from the head and adapted for receiving a mixer tool; a scraper support positioned alongside the rotatable output member and having a mount protrusion including a shaft and an enlarged head; and the bowl scraper connected to the scraper support with the mount protrusion extending through the second portion of the through opening.

15. The mixing machine of claim 14 wherein the scraper support includes a side shoulder and an edge of the upper arm portion lies adjacent the side shoulder.

16. A bowl scraper for use in a mixing machine, comprising:

an attachment arm including an upper arm portion and a lower arm portion, wherein the upper arm portion and the lower arm portion are formed by a bent elongated member, the upper arm portion including an opening extending through the bent elongated member, the opening having a first portion and a second portion, the first portion of the opening larger than the second portion of the opening, the first portion of the opening being sized and configured to receive a mount protrusion of the mixing machine for mounting the bowl scraper to the mixing machine; and a scraper extending downward from the lower arm portion;

wherein the upper arm portion extends substantially perpendicular to an axis of the bowl scraper, the lower arm portion includes a first segment connected to the upper arm portion and extending substantially downward therefrom and a second segment connected to the first segment and extending substantially outward from the first segment, wherein the scraper extends downward from the second segment.

* * * * *